US006877608B2

(12) United States Patent
Koike

(10) Patent No.: US 6,877,608 B2
(45) Date of Patent: Apr. 12, 2005

(54) CUSHION MATERIAL FOR PACKAGING AND PACKAGE

(75) Inventor: Motomu Koike, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 200 days.

(21) Appl. No.: 10/149,791

(22) PCT Filed: Oct. 15, 2001

(86) PCT No.: PCT/JP01/09047

§ 371 (c)(1),
(2), (4) Date: Jun. 12, 2002

(87) PCT Pub. No.: WO02/30787

PCT Pub. Date: Apr. 18, 2002

(65) Prior Publication Data

US 2002/0189970 A1 Dec. 19, 2002

(30) Foreign Application Priority Data

Oct. 13, 2000 (JP) ..... 2000-314266

(51) Int. Cl.[7] ..... B65D 81/113
(52) U.S. Cl. ..... 206/592; 206/591; 206/523
(58) Field of Search ..... 206/591, 592, 206/594, 523, 521, 576, 588, 320, 701, 723

(56) References Cited

U.S. PATENT DOCUMENTS 5,226,543 A * 7/1993 Foos et al. ..... 206/592
6,123,200 A * 9/2000 Stephens et al. ..... 206/592
6,298,989 B1 * 10/2001 Chu ..... 206/320

FOREIGN PATENT DOCUMENTS

| | | |
|---|---|---|
| JP | 1-39949 | 2/1985 |
| JP | 5-68876 | 9/1993 |
| JP | 7-89575 | 4/1995 |

* cited by examiner

*Primary Examiner*—Mickey Yu
*Assistant Examiner*—J. Gregory Pickett
(74) *Attorney, Agent, or Firm*—Michael T. Gabrik

(57) ABSTRACT

A package cushion member includes an upper pad 10 and a lower pad 20 from which a plurality of upper-pad hollow projections 15 and a plurality of lower-pad hollow projections 25 project so as to surround a storage space for a projector 50, and also adopts a reinforcing pad 30 having bottom-protecting hollow projections 31 which are in contact with recesses 22 of the lower pad 20, and side-reinforcing hollow projections 35 which are inserted halfway into the lower-pad hollow projections 25, when the reinforcing pad 30 is placed under the lower pad 20. This makes it possible to reliably prevent an outer case of a packed object from being broken even when the outer case is easily distorted at the center portion in the thickness direction.

19 Claims, 8 Drawing Sheets

(A)

(B)

(prior art)

(prior art)

CUSHION MATERIAL FOR PACKAGING AND PACKAGE

TECHNICAL FIELD

The present invention relates to a package cushion member which is used to pack an object in which the center portion in the thickness direction of an outer case is prone to distortion, and relates to a package in which an object is packed with the package cushion member.

BACKGROUND ART

When transporting an electronic device, such as a projector, packed in a cardboard box or the like, it is necessary to prevent the electronic device from being damaged by external impact. Accordingly, for example, a package cushion member 1' having an upper pad 10' and a lower pad 20' has hitherto been used, as shown in FIG. 7. That is, a first backing board 3, the lower pad 20', a projector 50 serving as a packed object, the upper pad 10', and a second backing board 4 are stacked in that order inside a cardboard box 2, and an accessory box 5 is put therein so as to fill the clearance in the cardboard box 2.

The upper pad 10' and the lower pad 20' are produced by pulp molding or other means, and a plurality of upper-pad hollow projections 15 and a plurality of lower-pad hollow projections 25 project therefrom so as to surround a storage space 21 for the projector 50. Therefore, the projector 50 is protected from vibration during transportation while it is surrounded by the upper-pad hollow projections 15 and the lower-pad hollow projections 25 between the upper pad 10' and the lower pad 20', as shown in FIG. 8. Although not shown in FIG. 7, recesses 22 of the lower pad 20' function as cushioning portions which protect the bottom surface of the projector 50, as shown in FIG. 8.

However, the cardboard box 2 with the projector 50 packed therein is sometimes inadvertently dropped during transportation. In such a case, for example, great impacts directed toward the bottom surface or the side of the cardboard box 2 are applied to the projector 50 inside the cardboard box 2, as shown by arrows A and B, and the projector 50 is sometimes broken.

Accordingly, as shown in FIG. 8, a structure is possible in which a reinforcing pad 30' having bottom-protecting hollow projections 31, which are in contact with the recesses 22 of the lower pad 20', is placed under the lower pad 20'. In such a structure, since the recesses 22 of the lower pad 20' and the bottom-protecting hollow projections 31 of the reinforcing pad 30' absorb the impact applied in the direction of arrow A, the bottom surface of the projector 50 is protected.

When an impact in the direction of arrow B is applied to the projector 50, the base portions of the upper-pad hollow projections 15 and the base portions of the lower-pad hollow projections 25 are crushed to absorb the impact. In contrast, since leading end portions 150 (lower ends) of the upper-pad hollow projections 15 and leading end portions 250 (upper ends) of the lower-pad hollow projections 25 have high rigidity with respect to the force applied from the direction of arrow B, when an impact is applied again after the base portions of the upper-pad hollow projections 15 and the base portions of the lower-pad hollow projections 25 are crushed, the center portion in the thickness direction of the outer case of the projector 50 abuts the leading end portions 150 of the upper-pad hollow projections 15 and the leading end portions 250 of the lower-pad hollow projections 25, and receives a great force. Furthermore, while, of upper, middle, and lower cases 51, 52, and 53 which constitute the outer case of the projector, the upper case 51 and the lower case 53 are formed of a die-cast case or a thick resin case which is rigid, the middle case 52 is made of an aluminum plate. Consequently, the center portion in the thickness direction of the outer case is more prone to distortion than the upper and lower portions. For this reason, when the leading end portions 150 of the upper-pad hollow projections 15 and the leading end portions 250 of the lower-pad hollow projections 250 abut the middle case 52, which is easily distorted, the middle case 52 is substantially dented.

In view of the above problems, an object of the present invention is to provide a package cushion member which can reliably prevent an outer case of a packed object from being broken even when the outer case is easily distorted at the center portion in the thickness direction, and to provide a package using the package cushion member.

DISCLOSURE OF INVENTION

In order to overcome the above problems, the present invention provides a package cushion member including an upper pad and a lower pad respectively having a plurality of upper-pad hollow projections and a plurality of lower-pad hollow projections projecting therefrom so as to surround a storage space for a packed object. The package cushion member also includes a reinforcing pad having bottom-protecting hollow projections which partly contact from below with a region of the lower pad corresponding to the bottom of the storage space, and side-reinforcing hollow projections which are inserted halfway into the lower-pad hollow projections when the reinforcing pad is placed under the lower pad.

In the present invention, since the reinforcing pad having the bottom-protecting hollow projections is placed under the lower pad, even when a great impact directed toward the bottom is applied to a packed object inside a cardboard box due to an inadvertent drop of the cardboard box with the object packed therein during transportation, such an impact is absorbed by the bottom-protecting hollow projections. Therefore, the bottom surface of the packed object can be protected. Moreover, since the side-reinforcing hollow projections of the reinforcing pad are inserted halfway into the lower-pad hollow projections, even when a great impact is repeatedly applied so that the packed object moves sideward inside the cardboard box, the base portions of the lower-pad hollow projections will not be crushed. Therefore, the high-rigidity portions, such as the leading end portions of the upper-pad hollow projections and the leading end portions of the lower-pad hollow projections, do not abut the side face of the packed object. For this reason, even when the middle case of the upper, middle, and lower cases which constitute the outer case of the packed object is weak, it can be prevented from being dented.

In the present invention, it is preferable that a clearance be formed between the leading end portions of the upper-pad hollow projections and the leading end portions of the lower-pad hollow projections when the packed object is placed between the upper pad and the lower pad. In such a structure, even when a great impact is applied so that the packed object moves sideward inside the cardboard box, the base portions of the lower-pad hollow projections and the base portions of the upper-pad hollow projections are crushed, and the leading end portions of the upper-pad hollow projections and the leading end portions of the lower-pad hollow projections abut the side face of the packed object, the leading end portions of the upper-pad hollow projections and the leading end portions of the lower-pad hollow projections do not hinder each other from deforming to absorb the impact since a clearance is formed therebetween. Consequently, it is possible to prevent a great force from being concentrated in the middle case or the like of the packed object, and to thereby avoid problems such as denting of the middle case.

In the present invention, it is preferable that the upper-pad hollow projections and the lower-pad hollow projections include a first hollow projection having a fragile portion which allows the leading end portion thereof to be easily deformed when an outward force is applied thereto. In such a structure, even when a great impact is applied so that the packed object moves sideward inside the cardboard box, the base portions of the lower-pad hollow projections and the base portions of the upper-pad hollow projections are crushed, and the leading end portions of the upper-pad hollow projections and the leading end portions of the lower-pad hollow projections abut the side face of the packed object, the leading end portions can also absorb the impact because they are easily deformed. A great force is not concentrated in the middle case or the like of the packed object, and therefore, problems such as denting of the middle case, can be avoided.

In the present invention, the fragile portion is, for example, a groove which has a thin bottom portion and extends in the circumferential direction in the leading end portion of the hollow projection.

In the present invention, it is preferable that the upper-pad hollow projections and the lower-pad hollow projections include a second hollow projection having a tapered face which is inclined so as to face the storage space and which is more deeply recessed as viewed from the storage space at the leading end than at the midpoint in the height direction. In such a structure, even when a great impact is applied so that the packed object moves sideward inside the cardboard box, and the base portions of the lower-pad hollow projections and the base portions of the upper-pad hollow projections are crushed, since the leading end portions of the upper-pad hollow projections and the leading end portions of the lower-pad hollow projections are not prone to abut the side face of the packed object, a great force will not be concentrated in the middle case or the like of the packed object. This makes it possible to avoid problems such as denting of the middle case.

In the present invention, it is preferable that the upper-pad hollow projections and the lower-pad hollow projections include a third hollow projection having a first reinforcing rib formed in a connecting portion between the adjoining hollow projections. In such a structure, even when a great impact is applied so that the packed object moves sideward inside the cardboard box, and a great force is exerted on the connecting portion between the adjoining hollow projections, since the connecting portion is reinforced by the first reinforcing rib, it is not crushed, but supports the packed object. For this reason, the base portions of the lower-pad hollow projections and the base portions of the upper-pad hollow projections are not crushed, the leading end portions of the upper-pad hollow projections and the leading end portions of the lower-pad hollow projections are not prone to abut the side face of the packed object, and therefore, a great force is not concentrated in the middle case or the like of the packed object. Consequently, it is possible to avoid problems such as denting of the middle case.

In the present invention, the first reinforcing rib is, for example, a convex or concave rib which extends from the inner side toward the outer side in the connecting portion between the adjoining hollow projections.

In the present invention, it is preferable that the side-reinforcing hollow projections include a fourth hollow projection with a second reinforcing rib which prevents the leading end portion thereof from being distorted when an outward force is applied thereto. In such a case, even when a great impact is applied so that the packed object moves sideward inside the cardboard box, and a great impact is applied to the base portions of the lower-pad hollow projections, the base portions of the lower-pad hollow projections will not be crushed because they are supported by the side-reinforcing hollow projections of the reinforcing pad which are reinforced by the second reinforcing ribs. For this reason, the leading end portions of the upper-pad hollow projections and the leading end portions of the lower-pad hollow projections are not prone to abut the side face of the packed object, and a great force is not concentrated in the middle case or the like of the packed object. This makes it possible to avoid problems such as denting of the middle case.

In the present invention, the second reinforcing rib is, for example, a convex or concave rib which extends from the inner side toward the outer side in the leading end portion of the fourth hollow projection.

In the present invention, it is preferable that the side-reinforcing hollow projections include a fifth hollow projection having a recess which is formed between the side-reinforcing hollow projection and the bottom-protecting hollow projection. Even when a great impact or the like is applied so that the packed object moves sideward inside the cardboard box, such a recess prevents the boundary portion between the side-reinforcing hollow projection and the bottom-protecting hollow projection from becoming tense. Therefore, the boundary portion can be prevented from being broken.

In the present invention, it is preferable that the upper-pad hollow projections and the lower-pad hollow projections include a sixth hollow projection having a tapered face which is inclined so as to point outward and which is more deeply recessed at the leading end than at the midpoint in the height direction, as viewed from the outside. In such a structure, the leading end portions of the upper-pad hollow projections and the leading end portions of the lower-pad hollow projections are separate from the cardboard box because of the tapered face. For this reason, even when external impact is applied to the center portion in the thickness direction of the side face of the outer cardboard box, it is not transmitted to the leading end portions of the upper-pad hollow projections and the leading end portions of the lower-pad hollow projections, and therefore, is not transmitted to the middle case and the like of the packed object. Consequently, it is possible to avoid problems such as denting of the middle case.

In the present invention, it is preferable that the upper pad, the lower pad, and the reinforcing pad have a rectangular shape in plan, and that some of the side-reinforcing hollow projections which are disposed at the corners of the reinforcing pad include a seventh hollow projection having a rib-shaped hollow projection which is shorter than the hollow projection and which extends outward from the outward-pointing surface of the hollow projection. In such a structure, even when a great impact is applied so that the packed object moves to the corner inside the cardboard box, since the side-reinforcing hollow projections of the reinforcing pad are not crushed at the corners because they are reinforced by the rib-shaped hollow projections. Since the base portions of the lower-pad hollow projections at the corners are not crushed, even when the cardboard box falls with its corner downside, a great force is not concentrated in the middle case or the like of the packed object. Consequently, it is possible to avoid problems such as denting of the middle case. Since the rib-shaped hollow projection is short, it is separate from the center portion in the thickness direction of the cardboard box. For this reason, even when an external impact is applied to the center portion in the thickness direction of the side face of the cardboard box, it is not transmitted to the middle case or the like of the packed object via the leading end portions of the upper-pad hollow projections and the lower-pad hollow projections. Consequently, it is possible to avoid problems such as denting of the middle case.

In the present invention, the upper pad, the lower pad, and the reinforcing pad are, for example, pads formed by pulp molding.

In the present invention, the packed object is an electronic device in which the center portion in the thickness direction of an outer case is more prone to distortion than the upper and lower portions, for example, a projector in which, of upper, middle, and lower cases which constitute an outer case, the middle case is more prone to distortion than the upper case and the lower case.

The present invention also provides a package cushion member including an upper pad and a lower pad respectively having a plurality of upper-pad hollow projections and a plurality of lower-pad hollow projections projecting therefrom so as to surround a storage space for a packed object. The package cushion member also includes a reinforcing pad having side-reinforcing hollow projections which are inserted in the lower-pad hollow projections so as to reach the positions of the lower-pad hollow projections, with which corner portions or edge portions of the packed object contact, when the reinforcing pad is placed under the lower pad.

In the present invention, since the side-reinforcing hollow projections of the reinforcing pad are inserted in the lower-pad hollow projections so as to reach the positions of the lower-pad hollow projections with which the corner portions or the edge portions of the packed object contact, even when a great impact is repeatedly applied so that the packed object moves downward and sideward inside the cardboard box, the base portions of the lower-pad hollow projections will not be crushed. Therefore, the high-rigidity portions, such as the leading end portions of the upper-pad hollow projections and the leading end portions of the lower-pad hollow projections, do not abut the side face of the packed object. For this reason, even when the middle case of the upper, middle, and lower cases which constitute the outer case of the packed object is weak, it is possible to avoid problems such as denting of the middle case.

In the present invention, it is preferable that surfaces of the lower-pad hollow projections with which the bottom corner portions or edge portions of the packed object contact be formed of tapered faces which are inclined so as to be more deeply recessed as viewed from the storage space at the leading end. Further, it is preferable that the packed object be an electronic device having upper and lower portions in the thickness direction, and a middle portion sandwiched between the upper and lower portions, that the middle portion be more prone to distortion than the upper and lower portions, and that a clearance be formed between the lower-pad hollow projections and the center portion when the packed object is placed between the upper pad and the lower pad. In such a structure, even when a great impact is applied so that the packed object moves sideward inside the cardboard box, and the base portions of the lower-pad hollow projections and the base portions of the upper-pad hollow projections are crushed, a great force is not concentrated in the middle case or the like of the packed object because the leading end portions of the upper-pad hollow projections and the leading end portions of the lower-pad hollow projections are not prone to abut the side face of the packed object. This makes it possible to avoid problems such as denting of the middle case.

In a package of the present invention, the packed object is packed in a cardboard box or the like with the package cushion member.

BEST MODE FOR CARRYING OUT THE INVENTION

Embodiments of the present invention will be described with reference to the attached drawings.

Figure 1:
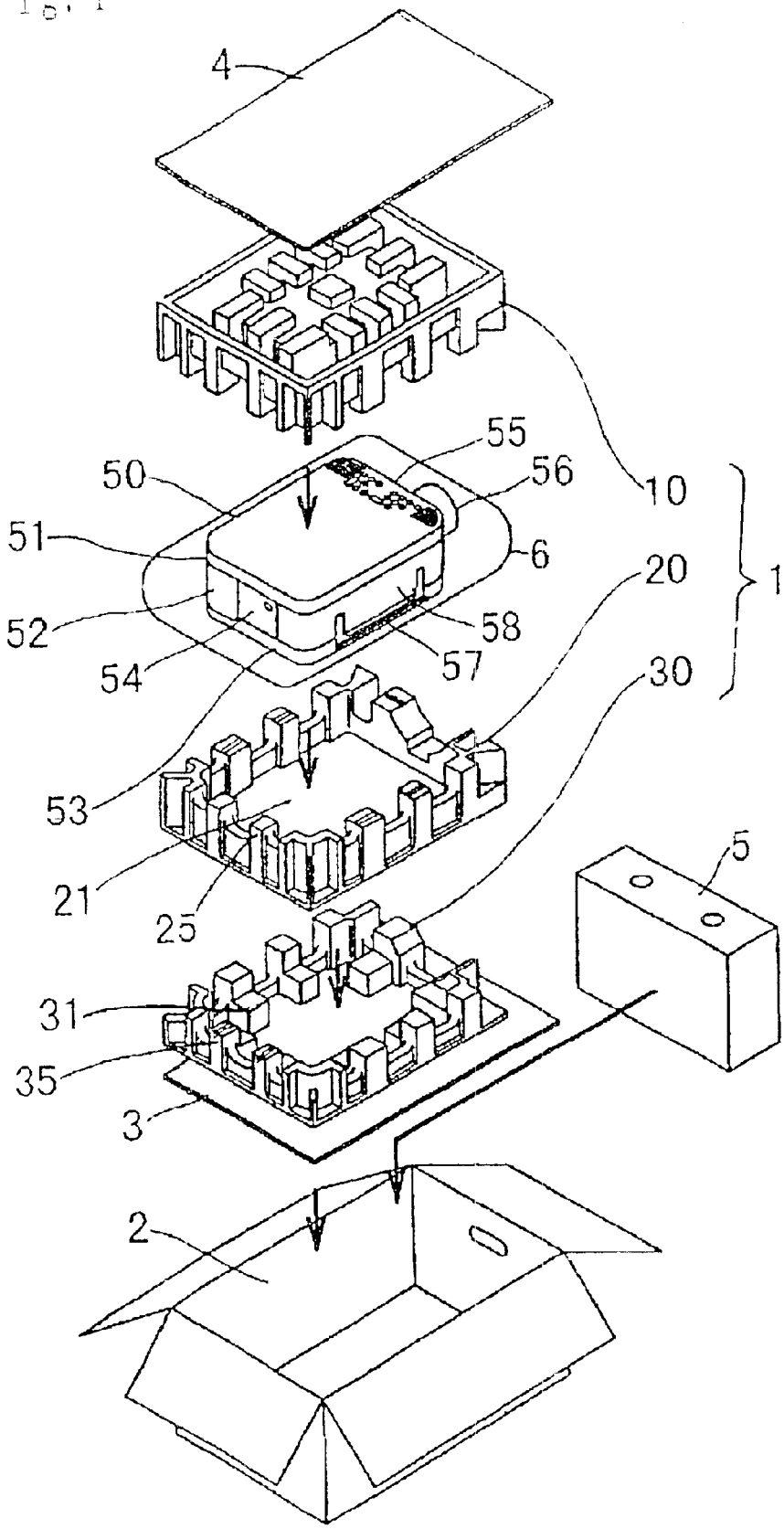
FIG. 1 is an explanatory view showing a state in which a projector (electronic device) serving as a packed object is packed in a cardboard box with a package cushion member to which the present invention is applied.
Figure 2:
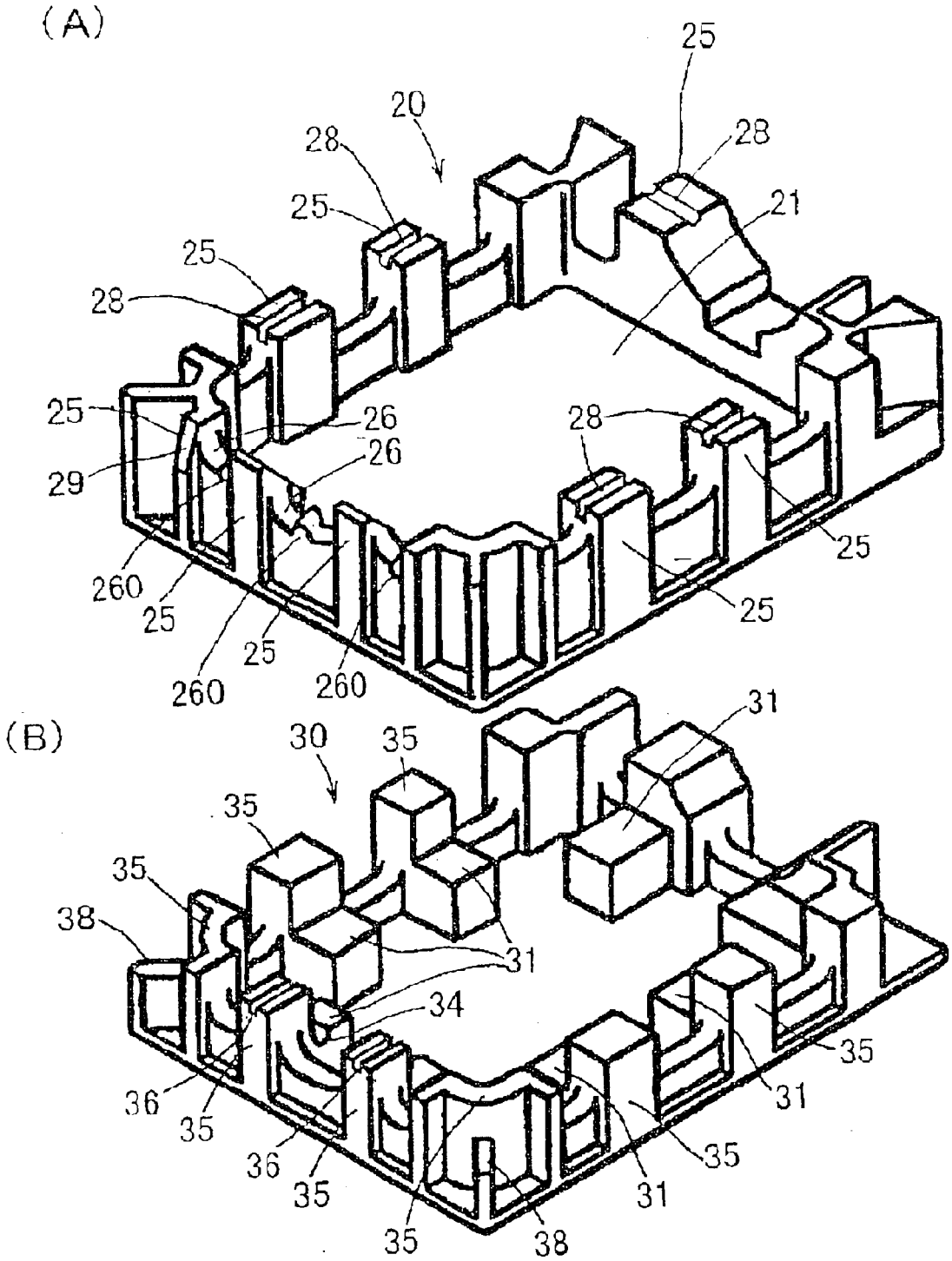
FIGS. 2(A) and 2(B) are explanatory views, respectively, of a lower pad and a reinforcing pad which are used to constitute the package cushion member shown in FIG. 1.
Figure 3:
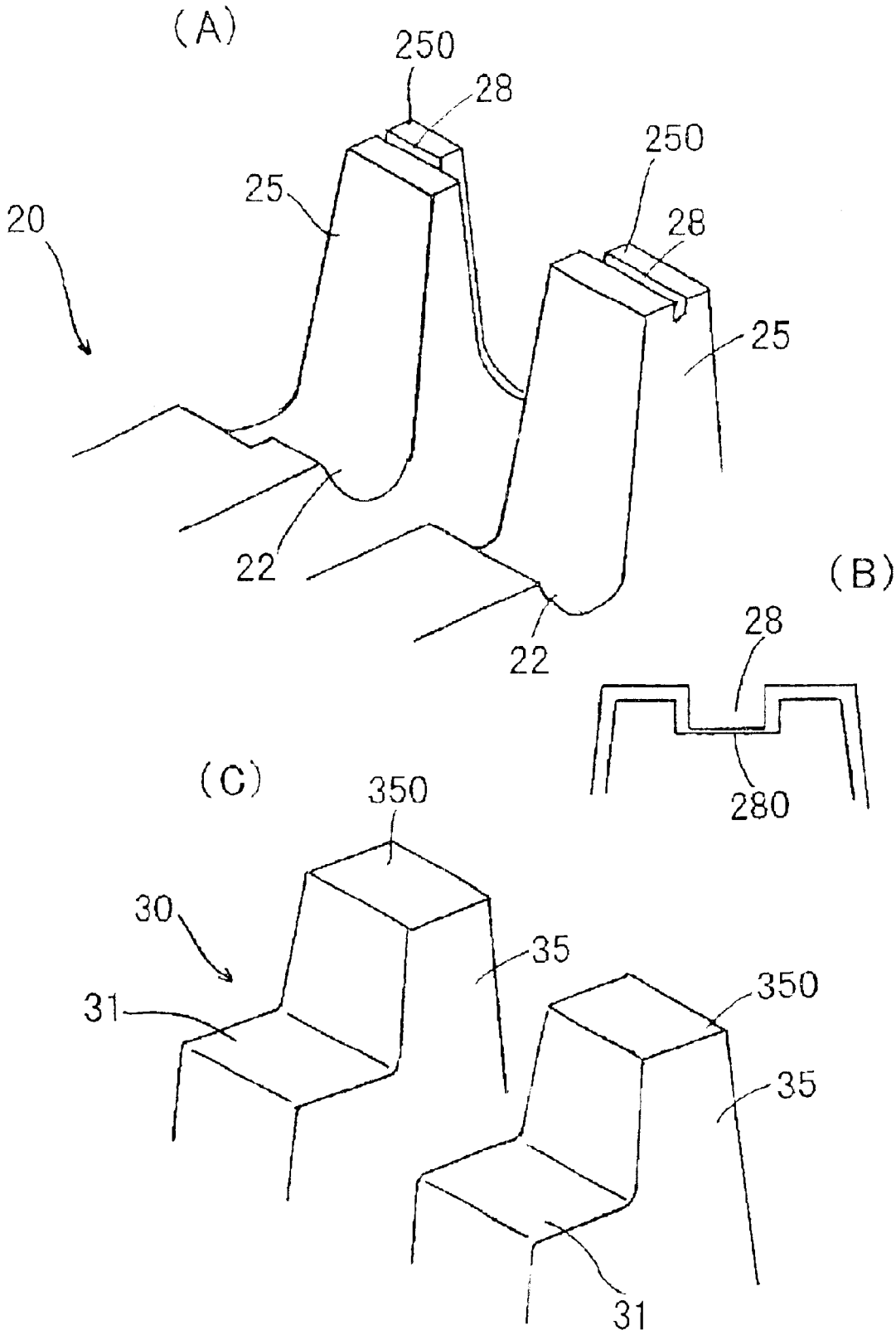
FIG. 3(A) is a partial enlarged explanatory view of lower-pad hollow projections formed at the right and left ends of the lower pad shown in FIG. 1.
FIG. 3(B) is a sectional view of the leading end of the lower-pad hollow projection.
FIG. 3(C) is a partial enlarged view of side-reinforcing hollow projections formed at the right and left ends of the reinforcing pad shown in FIG. 1.
Figure 4:
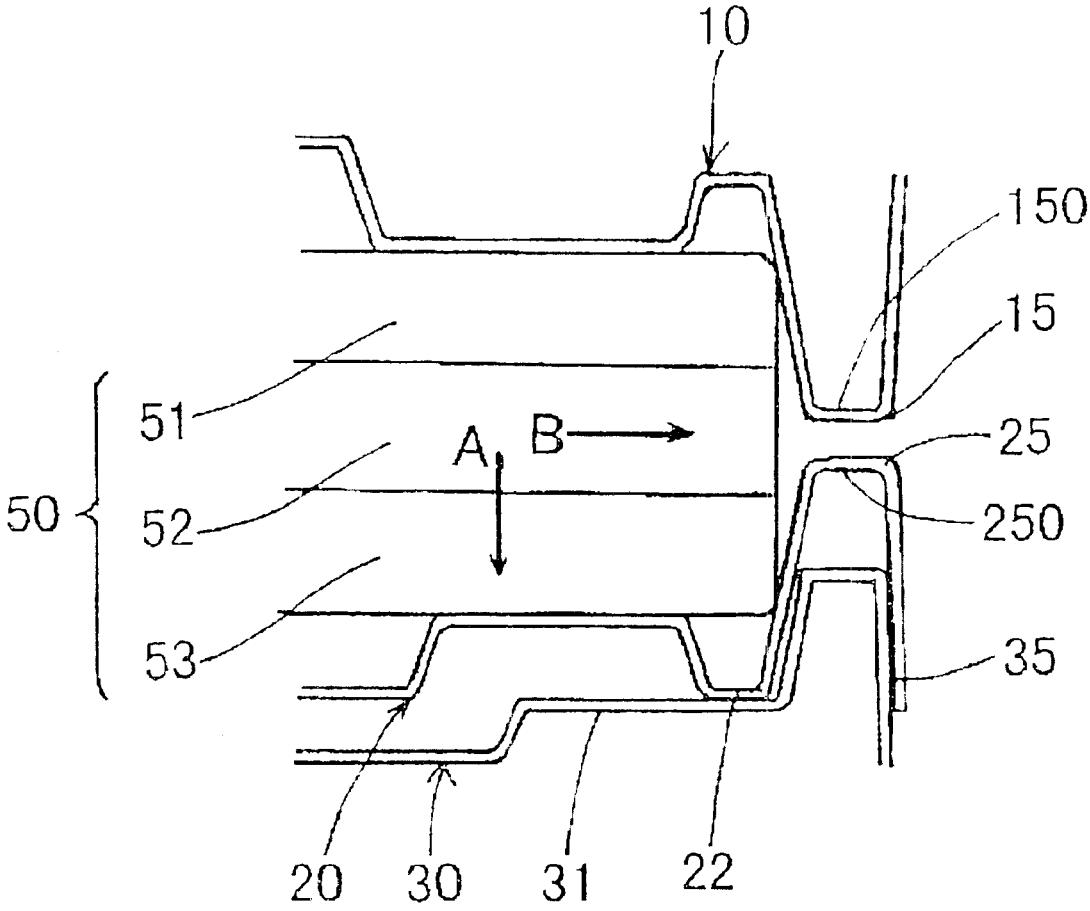
FIG. 4 is a sectional view showing a state in which the projector is stored with the side-reinforcing hollow projection shown in FIG. 3(B) inserted halfway into the lower-pad hollow projection shown in FIG. 3(A).
Figure 5:
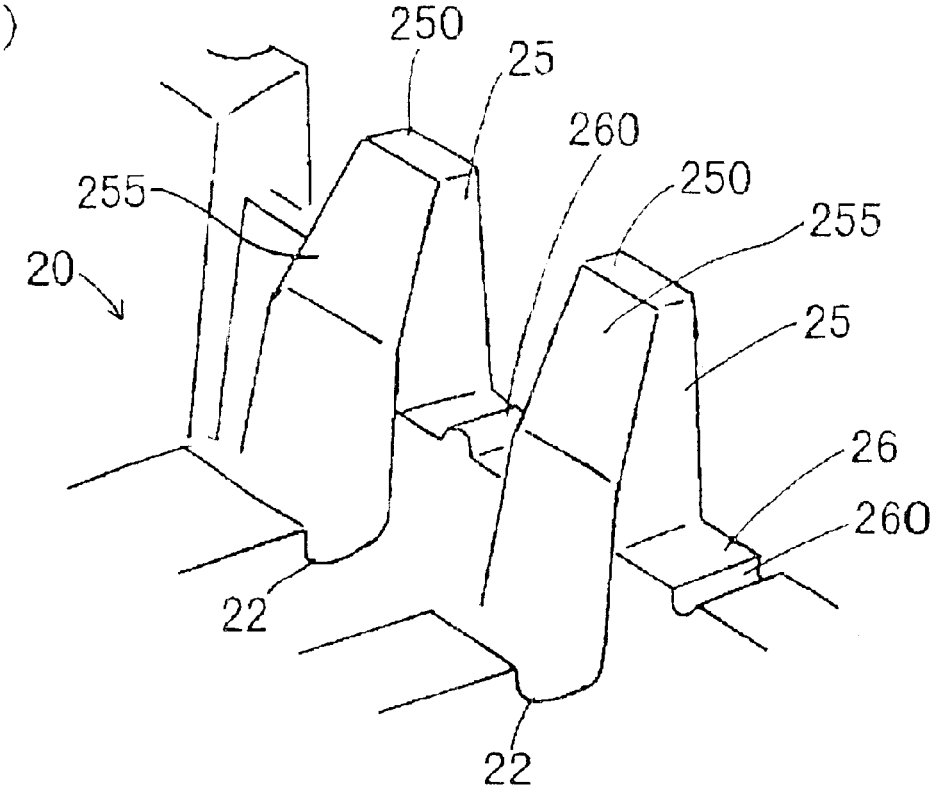
FIG. 5(A) is a partial enlarged explanatory view of lower-pad hollow projections formed at the rear end of the lower pad shown in FIG. 1.
FIG. 5(B) is a partial enlarged view of side-reinforcing hollow projections formed at the rear end of the reinforcing pad shown in FIG. 1.
Figure 5:
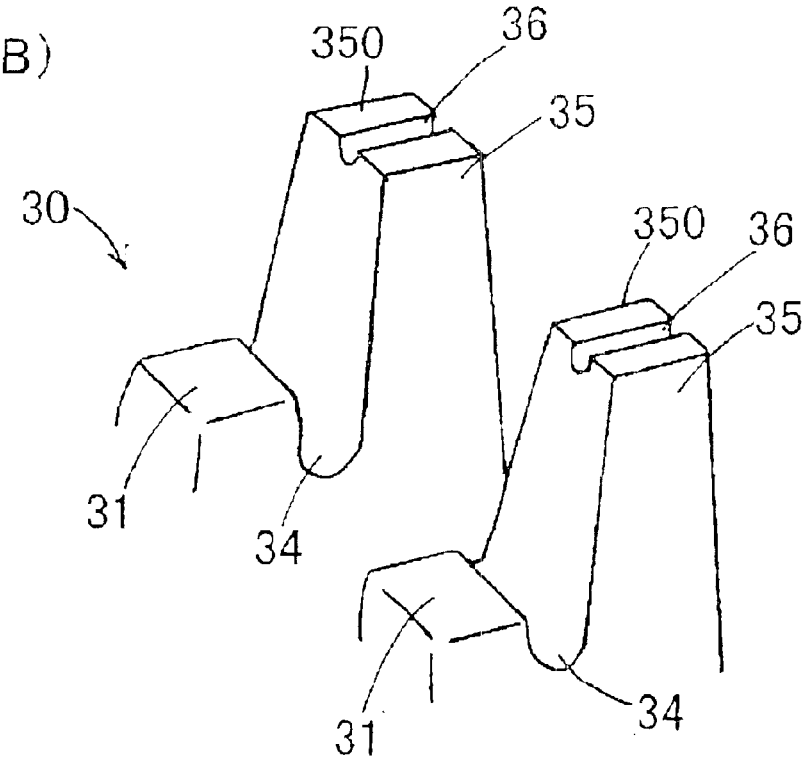
Figure 6:
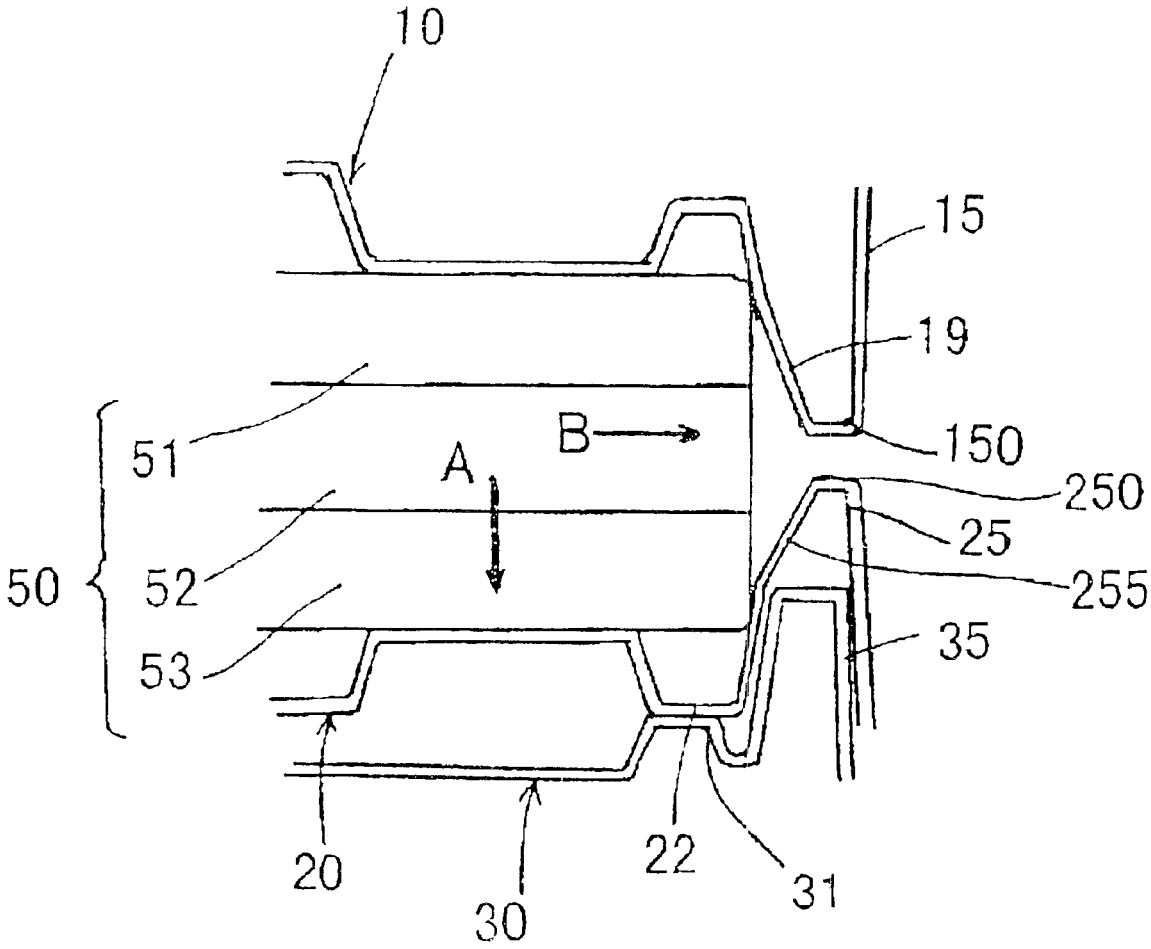
FIG. 6 is a sectional view showing a state in which the projector is stored with the side-reinforcing hollow projection shown in FIG. 5(B) inserted halfway into the lower-pad hollow projection shown in FIG. 5(A).
Figure 7:
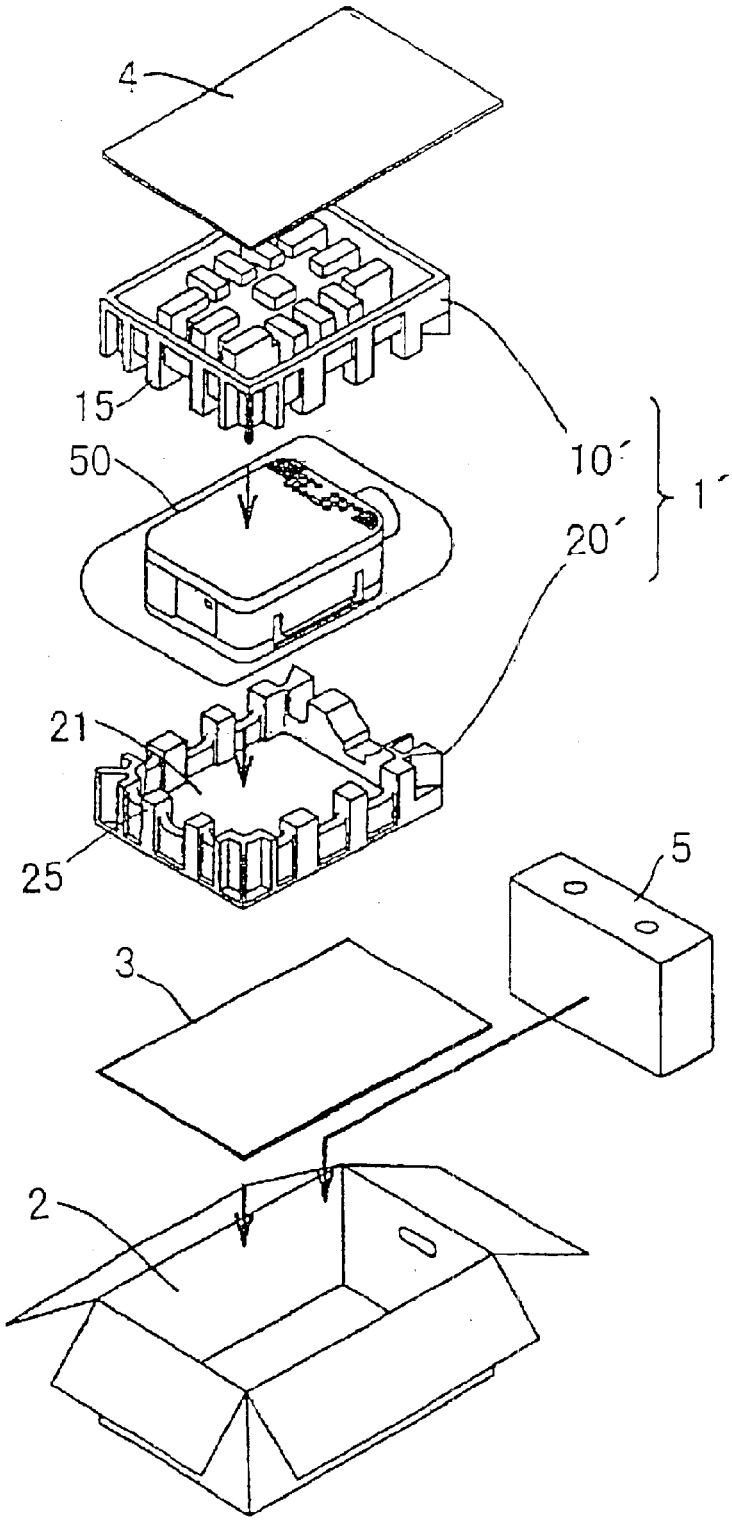
FIG. 7 is an explanatory view showing a state in which a projector (electronic device) serving as a packed object is packed in a cardboard box with a known package cushion member.
Figure 8:
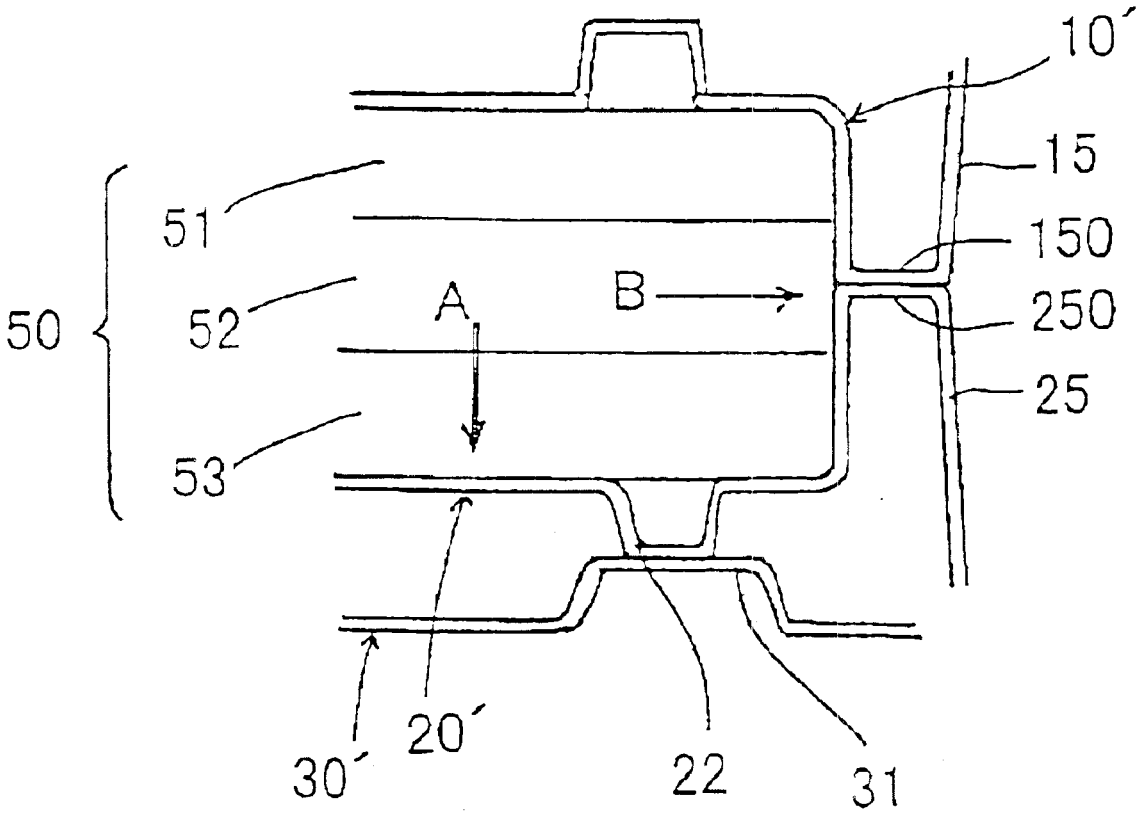
FIG. 8 is a sectional view showing a state in which the projector is placed inside the known package cushion members.

FIG. 1 is an explanatory view showing a state in which a projector (electronic device) serving as a packed object is packed in a cardboard box with a package cushion member to which the present invention is applied, and FIGS. 2(A) and 2(B) are explanatory views, respectively, of a lower pad and a reinforcing pad which are used to constitute the package cushion member. FIG. 3(A) is an enlarged explanatory view showing the surroundings of lower-pad hollow projections formed at the right and left ends of the lower pad shown in FIG. 1, FIG. 3(B) is a sectional view of the leading end of the lower-pad hollow projection, and FIG. 3(C) is an enlarged view showing the surroundings of side-reinforcing hollow projections formed at the right and left ends of the reinforcing pad shown in FIG. 1. FIG. 4 is a sectional view showing a state in which the projector is stored while the side-reinforcing hollow projection shown in FIG. 3(B) is inserted halfway into the lower-pad hollow projection shown in FIG. 3(A). FIG. 5(A) is an enlarged explanatory view showing the surroundings of lower-pad hollow projections formed at the rear end of the lower pad shown in FIG. 1, and FIG. 5(B) is an enlarged view showing the surroundings of side-reinforcing hollow projections formed at the rear end of the reinforcing pad shown in FIG. 1. FIG. 6 is a sectional view showing a state in which the projector is stored while the side-reinforcing hollow projection shown in FIG. 5(B) is inserted halfway into the lower-pad hollow projection shown in FIG. 5(A). In FIGS. 1 and 2, recesses of the lower pad and the like are not shown.

In FIG. 1, an object to be packed by using a package cushion member 1 of this embodiment is a projector 50. A lens barrel 56 having a projection lens (not shown) therein projects from a front end face 55 of the projector 50, and a handle 57 is attached to a right side face 58 of the right and left side faces, as viewed from the rear side (in the direction of projection of an image).

Of an upper case 51, a middle case 52, and a lower case 53 which constitute an outer case of the projector 50, the upper case 51 and the lower case 53 are formed of, for example, a die-cast case or a thick resin case and are rigid, and the middle case 52 is made of an aluminum plate. Therefore, the center portion in the thickness direction of the outer case is more prone to distortion than the upper and lower portions. On the rear end face of the projector 50, a cover 54 is attached to the middle case 52 so that it is opened and closed when replacing a light-source lamp (not shown). The strength of the portion at the cover 54 is particularly low.

In this embodiment, a package cushion member 1 including a reinforcing pad 30, a lower pad 20, and an upper pad 10 is used in order to pack such a projector 50 in a cardboard box 2. That is, when the projector 50 is packed in the cardboard box 2, a first backing board 3, the reinforcing pad 30, the lower pad 20, the projector 50 wrapped in a sheet 6, the upper pad 10, and a second backing board 4 are stacked in that order inside the cardboard box 2, and an accessory box 5 is put therein so as to fill the clearance in the cardboard box 2.

As shown in FIGS. 2(A) and 2(B), the upper pad 10 and the lower pad 20 are formed by pulp molding, and a plurality of upper-pad hollow projections 15 and a plurality of lower-pad hollow projections 25 protrude therefrom so as to surround a storage space 21 for the projector 50. Therefore, the projector 50 is protected from vibration during transportation by being surrounded by the upper-pad hollow projections 15 and the lower-pad hollow projections 25 between the upper pad 10 and the lower pad 20.

In a case in which the cardboard box 2 having the projector 50 packed therein is inadvertently dropped during transportation, great impacts are applied to the projector 50 inside the cardboard box 2 so that the projector 50 moves toward the bottom face or to the side of the cardboard box 2, for example, as shown by arrows A and B in FIGS. 4 and 6. Measures suited to the components are taken so that the bottom face of the projector 50 or the middle case 52 and the cover 54 having low strength will not be damaged in such a case.

(Basic Measures)

As shown in FIGS. 3(A) and 3(C), recesses 22 are formed in the storage space 21 of the lower pad 20 at portions corresponding to the right and left ends of the projector 50, and the reinforcing pad 30 has bottom-protecting hollow projections 31 which are in contact with the recesses 22 of the lower pad 10 from below when the reinforcing pad 30 is placed under the lower pad 10. The reinforcing pad 30 also has side-reinforcing hollow projections 35 which are inserted halfway into the lower-pad hollow projections 25 of the lower pad 20.

For this reason, as shown in FIG. 4, when the projector 50 is placed between the lower pad 20 and the upper pad 10 in a state in which the reinforcing pad 30 is placed under the lower pad 20, the bottom surface of the projector 50 is supported by the lower pad 20. In the lower pad 20, the recesses 22 of the lower pad 20 are supported from below by the bottom-protecting hollow projections 31 of the reinforcing pad 30. The bottom corner portions or edge portions of the projector 50 are supported at the midpoints in the height direction of the lower-pad hollow projections 25, and the side-reinforcing hollow projections 35 of the reinforcing pad 30 are inserted into the midpoints. In this state, a clearance is formed between leading end portions 250 (upper ends) of the lower-pad hollow projections 25 and leading end portions 150 (lower ends) of the upper-pad hollow projections 15.

As shown in FIGS. 5(A) and 5(B), recesses 22 are also formed on the lower pad 20 at portions corresponding to the rear end of the projector 50, and the reinforcing pad 30 has bottom-protecting hollow projections 31 which are in contact with the recesses 22 of the lower pad 20 from below when the reinforcing pad 30 is placed under the lower pad 20. The reinforcing pad 30 also has side-reinforcing hollow projections 35 which are inserted halfway into the lower-pad hollow projections 25 of the lower pad 20.

For this reason, when the projector 50 is placed between the lower pad 20 and the upper pad 10 in a state in which the reinforcing pad 30 is placed under the lower pad 20, the bottom surface of the projector 50 is also supported by the lower pad 20 at the rear end of the projector 50, as shown in FIG. 6. Moreover, in the lower pad 20, the recesses 22 of the lower pad 20 are supported from below by the bottom-protecting hollow projections 31 of the reinforcing pad 30. The bottom corner portions or edge portions of the projector 50 are supported at the midpoints in the height direction of the lower-pad hollow projections 25, and the side-reinforcing hollow projections 35 of the reinforcing pad 30 are inserted into the midpoints. In this state, a clearance is formed between leading end portions 250 (upper ends) of the lower-pad hollow projections 25 and leading end portions 150 (lower ends) of the upper-pad hollow projections 15.

In this way, in this embodiment, even when a great impact toward the bottom surface is applied to the projector 50 inside the cardboard box 2 because the cardboard box 2 with the projector 50 packed therein is inadvertently dropped during transportation, such an impact is absorbed by the recesses 22 of the lower pad 20 and the bottom-protecting hollow projections 31 of the reinforcing pad 30. Consequently, the bottom surface of the projector 50 can be protected.

Since the side-reinforcing hollow projections 35 of the reinforcing pad 30 are inserted halfway into the lower-pad hollow projections 25, even when a great impact toward the side face is applied to the projector 50 inside the cardboard box 2, the base portions of the lower-pad hollow projections 25 will not be crushed. Therefore, the high-rigidity portions which withstand the force from the lateral direction, such as the leading end portions 250 of the lower-pad hollow projections 25, will not abut the middle case 52 of the projector 50. For this reason, even when the middle case 52 of the upper, middle, and lower cases 51, 52, and 53, which constitute the outer case of the projector 50, has low strength, it is possible to avoid problems such as denting of the middle case 50.

Furthermore, since the clearance is formed between the leading end portions 250 of the lower-pad hollow projections 25 and the leading end portions 150 of the upper-pad hollow projections 15 in this embodiment, even when the leading end portions 150 of the upper-pad hollow projections 15 or the leading end portions 250 of the lower-pad hollow projections 25 abut the middle case 52 of the projector 50 due to crushing of the base portions of the lower-pad hollow projections 25 or the base portions of the upper-pad hollow projections 15, the leading end portions 150 and 250 do not hinder each other from being deformed. For this reason, when the leading end portions 150 of the upper-pad hollow projections 15 or the leading end portions 250 of the lower-pad hollow projections 25 abut the middle case 52 of the projector 50, they are crushed, thereby preventing the middle case 52 from being dented.

(First Hollow—Projection Structure)

In this embodiment, the lower-pad hollow projections 25 shown in FIG. 3(A) have a first hollow-projection structure in which a fragile portion 28 is formed so as to allow easy deformation of the leading end portion 250. That is, the leading end portions 250 of the upper-pad hollow projections 25 are provided with the fragile portions 28 which have a thin bottom portion 280 and which is formed of a groove extending in the circumferential direction, as shown in FIG. 3(B).

Although not shown, some of the plurality of upper-pad hollow projections 15 have a fragile portion which is formed of a similar groove.

In the lower-pad hollow projections 25 or the upper-pad hollow projections 15 having such a first hollow-projection structure, even when the leading end portions 150 of the upper-pad hollow projections 15 or the leading end portions 250 of the lower-pad hollow projections 25 abut the middle case 52 of the projector 50 because the base portions of the lower-pad hollow projections 25 or the base portions of the upper-pad hollow projections 15 are crushed by the application of a great impact toward the side of the projector 50 inside the cardboard box 2, the leading end portions 150 or 250 are easily deformed because of the fragile portions 28. Consequently, the leading end portions 150 or 250 will not dent the middle case 52.

(Second Hollow—Projection Structure)

In this embodiment, the lower-pad hollow projections 25 shown in FIGS. 5(A) and 5(B) have a second hollow-projection structure in which a tapered face 255 inclined upward is formed so that it faces the storage space 21 and so that its leading end portion is more deeply recessed as viewed from the storage space than the midpoint in the height direction.

As shown in FIG. 6, some of the upper-pad hollow projections 15 also have a second hollow-projection structure in which a tapered face 19 inclined downward is formed so that it faces the storage space and so that its leading end portion is more deeply recessed as viewed from the storage space than the midpoint in the height direction.

In the lower-pad hollow projections 25 or the upper-pad hollow projections 15 having such a second hollow-projection structure, even when the base portions of the lower-pad hollow projections 25 or the base portions of the upper-pad hollow projections 15 are crushed by the application of a great impact toward the side of the projector 50 inside the cardboard box 2, since the leading end portions 150 of the upper-pad hollow projections 15 or the leading end portions 250 of the lower-pad hollow projections 25 are recessed because of the tapered surface 19 or 255, they do not abut the middle case 52 or the cover 54 of the projector 50. For this reason, it is possible to avoid problems such as denting of the middle case 52 and the cover 54.

(Third Hollow—Projection Structure)

In this embodiment, the lower-pad hollow projections 25 shown in FIG. 5(A) have a third hollow-projection structure in which a first reinforcing rib 260 is formed in a connecting portion 26 between the adjoining hollow projections. That is, the first reinforcing rib 260 made of a convex rib or a concave rib extending from the inner side to the outer side is formed in the connecting portion 26 between the adjoining lower-pad hollow projections 25.

Although not shown, some of the upper-pad hollow projections 15 also have the third hollow-projection structure in which a first reinforcing rib is formed in the connecting portion between the adjoining hollow projections.

In the lower-pad hollow projections 25 or the upper-pad hollow projections 15 having such a third hollow-projection structure, even when a great force is exerted on the connecting portion 26 due to the application of a great impact such that the projector 50 moves sideward inside the cardboard box 2, since the connecting portion 26 is reinforced by the first reinforcing rib 260, it is not crushed, but supports the portion of the projector 50 corresponding to the upper case 51 or the lower case 53. For this reason, the base portions of the lower-pad hollow projections 25 or the base portions of the upper-pad hollow projections 15 are not crushed, and the leading end portions 150 of the upper-pad hollow projections 15 or the leading end portions 250 of the lower-pad hollow projections 25 do not abut the middle case 52 or the cover 54 of the projector 50. Consequently, it is possible to avoid problems such as denting of the middle case 52 and the cover 54.

(Fourth Hollow—Projection Structure)

In this embodiment, the side-reinforcing hollow projections 35 shown in FIG. 5(B) have a fourth hollow-projection structure in which a second reinforcing rib 36 is formed so as to prevent the leading end portion 350 of the hollow projection from being distorted when an outward force is exerted thereon. That is, the leading end portions 350 of the side-reinforcing hollow projections 35 are provided with the second reinforcing rib 36 which is formed of a concave rib extending from the inner side to the outer side.

In the side-reinforcing hollow projections 35 having such a fourth hollow-projection structure, even when a great impact is applied to the base portions of the lower-pad hollow projections 25 by the application of a great sideward impact on the projector 50 inside the cardboard box 2, the base portions of the lower-pad hollow projections 25 are not crushed because they are supported by the side-reinforcing hollow projections 35 which is reinforced by the second reinforcing rib 36. For this reason, the leading end portions 250 of the lower-pad hollow projections 25 do not abut the middle case 52 or the cover 54 of the projector 50, and this can avoid problems such as denting of the middle case 52 and the cover 54.

The second reinforcing rib 36 may be a convex rib.

(Fifth Hollow—Projection Structure)

In this embodiment, the side-reinforcing hollow projections 35 shown in FIG. 5(B) have a fifth hollow-projection structure in which a recess 34 is formed between the side-reinforcing hollow projection 35 and the bottom-protecting hollow projection 31. For this reason, even when a great impact is applied so that the projector 50 moves sideward inside the cardboard box 2, the boundary portions between the side-reinforcing hollow projections 35 and the bottom-protecting hollow projections 31 are not tensed. Consequently, it is possible to prevent the boundary portions from being broken.

(Sixth Hollow—Projection Structure)

As shown in FIG. 2, some of the plurality of lower-pad hollow projections 25 which are formed at the corners have a sixth hollow-projection structure in which a tapered face 29 inclined upward is formed so that it points outward and so that its leading end portion is more deeply recessed than the midpoint in the height direction, as viewed from the outside.

Although not shown, some of the upper-pad hollow projections 15 also have the sixth hollow-projection structure in which a tapered face inclined downward is formed so that it points outward and so that its leading end portion is more deeply recessed than the midpoint in the height direction, as viewed from the outside.

The leading end portions 150 or 250 of the lower-pad hollow projections 25 or the upper-pad hollow projections 15 having such a sixth hollow-projection structure are separate from the inner surface of the cardboard box 2. For this reason, even when external impact is applied to the center portion in the thickness direction of the side face of the outer cardboard box 2, it is not transmitted to the leading end portions 150 of the upper-pad hollow projections 15 and the leading end portions 250 of the lower-pad hollow projections 25, and is not transmitted to the middle case 52 of the projector 50. Consequently, it is possible to avoid problems such as denting of the middle case 52.

(Seventh Hollow—Projection Structure)

As shown in FIG. 2, some of the side-reinforcing hollow projections 35 which are placed at the corners of the reinforcing pad 30 have a seventh hollow-projection structure in which a rib-shaped hollow projection 38 shorter than the hollow projection extends outward from the outward-pointing surface of the hollow projection.

For this reason, even when a great impact is applied so that the projector 50 moves toward the corner inside the cardboard box 2, the side-reinforcing hollow projection 35 is rigid because it is supported by the rib-shaped hollow projection 38. Therefore, even when the cardboard box 2 is dropped with the corner facing down, the side-reinforcing hollow projection 35 at the corner is not crushed. Since the rib-shaped hollow projection 38 is short, the leading end thereof is separate from the inner surface of the cardboard box 2. For this reason, even when external impact is applied to the center portion in the thickness direction of the side face of the outer cardboard box 2, it is not transmitted to the rib-shaped hollow projection 38, and therefore, is not transmitted to the middle case 52 of the projector 50 via the side-reinforcing hollow projection 35. Consequently, it is possible to avoid problems such as denting of the middle case 52.

As described above, in the present invention, since the reinforcing pad having the bottom-protecting hollow projections is placed under the lower pad, even when a great impact toward the bottom surface is applied to the object packed in the cardboard box because the cardboard box having the object packed therein is inadvertently dropped during transportation, it is absorbed by the bottom-protecting hollow projections. Therefore, the bottom surface of the packed object can be protected. Furthermore, since the side-reinforcing hollow projections of the reinforcing pad are inserted halfway into the lower-pad hollow projections, even when a great impact is repeatedly applied so that the packed object moves sideward in the cardboard box, the base portions of the lower-pad hollow projections are not crushed. For this reason, the high-rigidity portions, such as the leading end portions of the upper-pad hollow projections and the leading end portions of the lower-pad hollow projections, will not abut the side face of the packed object. Consequently, even when the middle case of the upper, middle, and lower cases which constitute the outer case of the packed object has low strength, it can be prevented from being dented.

What is claimed is:

1. A package cushion member having an upper pad and a lower pad respectively having a plurality of upper-pad hollow projections and a plurality of lower-pad hollow projections projecting therefrom so as to surround a storage space for a packed object, the package cushion member further comprising:

a reinforcing pad including bottom-protecting hollow projections which contact bottom surfaces of correspondingly positioned recesses of the lower pad, the bottom surfaces of the recesses being spaced apart from the bottom of the storage space, and side-reinforcing hollow projections which are inserted approximately halfway into correspondingly positioned lower-pad hollow projections, when the reinforcing pad is placed under the lower pad.

2. A package cushion member according to claim 1, wherein a clearance is formed between leading end portions of the upper-pad hollow projections and leading end portions of the lower-pad hollow projections when the packed object is placed between the upper pad and the lower pad.

3. A package cushion member according to claim 1, wherein the upper-pad hollow projections and the lower-pad hollow projections include a first hollow projection having a fragile portion which allows a leading end portion thereof to be easily deformed when an outward force is applied thereto.

4. A package cushion member according to claim 3, wherein the fragile portion is a groove which has a thin bottom portion and extends in the circumferential direction in the leading end portion of the hollow projection.

5. A package cushion member according to claim 1, wherein the upper-pad hollow projections and the lower-pad hollow projections include a second hollow projection having a tapered face which is inclined so as to face the storage space and which is more deeply recessed as viewed from the storage space at the leading end than at the midpoint in the height direction.

6. A package cushion member according to claim 1, wherein the upper-pad hollow projections and the lower-pad hollow projections include a third hollow projection having a first reinforcing rib formed in a connecting portion between the adjoining hollow projections.

7. A package cushion member according to claim 6, wherein the first reinforcing rib is a convex or concave rib which extends from the inner side toward the outer side in the connecting portion between the adjoining hollow projections.

8. A package cushion member according to claim 1, wherein the side-reinforcing hollow projections include a fourth hollow projection with a second reinforcing rib which prevents a leading end portion thereof from being distorted when an outward force is applied thereto.

9. A package cushion member according to claim 8, wherein the second reinforcing rib is a convex or concave rib which extends from the inner side toward the outer side in the leading end portion of the fourth hollow projection.

10. A package cushion member according to claim 1, wherein the side-reinforcing hollow projections include a fifth hollow projection having a recess which is formed between the side-reinforcing hollow projection and the bottom-protecting hollow projection.

11. A package cushion member according to claim 1, wherein the upper-pad hollow projections and the lower-pad hollow projections include a sixth hollow projection having a tapered face which is inclined so as to point outward and which is more deeply recessed at the leading end than at the midpoint in the height direction, as viewed from the outside.

12. A package cushion member according to claim 1, wherein the upper pad, the lower pad, and the reinforcing pad have a rectangular shape in plan, and some of the side-reinforcing hollow projections which are disposed at the corners of the reinforcing pad include a seventh hollow projection having a rib-shaped hollow projection which is shorter than the hollow projection and which extends outward from an outward-pointing surface of the hollow projection.

13. A package cushion member according to claim 1, wherein the upper pad, the lower pad, and the reinforcing pad are formed by pulp molding.

14. A package cushion member according to claim 1, wherein the package cushion member is adapted to support as a packed object an electronic device in which a center portion in the thickness direction of an outer case is more prone to distortion than upper and lower portions.

15. A package cushion member according to claim 1, wherein the package cushion member is adapted to support as a packed object an electronic device in which, of upper, middle, and lower portions which constitute an outer case, the middle portion is more prone to distortion than the upper case and the lower case.

16. A package cushion member according to claim 1, wherein the side-reinforcing hollow projections of the reinforcing pad are inserted in the correspondingly positioned lower-pad hollow projections so as to reach the positions of the lower-pad hollow projections, with which corner portions or edge portions of the packed object contact, when the reinforcing pad is placed under the lower pad.

17. A package cushion member according to claim 16, wherein surfaces of the lower-pad hollow projections with which the bottom corner portions or edge portions of the packed object contact are formed of tapered faces which are inclined so as to be more deeply recessed as viewed from the storage space at the leading end.

18. A package cushion member according to claim 16, wherein the packed object is an electronic device having upper and lower portions in the thickness direction, and a middle portion sandwiched between the upper and lower portions, the middle portion is more prone to distortion than the upper and lower portions, and a clearance is formed between the lower-pad hollow projections and the center portion when the packed object is placed between the upper pad and the lower pad.

19. A package in which a packed object is packed in a cardboard box with a package cushion member, the package cushion member having an upper pad and a lower pad respectively having a plurality of upper-pad hollow projections and a plurality of lower-pad hollow projections projecting therefrom so as to surround a storage space for a packed object, the package cushion member further comprising:

a reinforcing pad including bottom-protecting hollow projections which contact bottom surfaces of correspondingly positioned recesses of the lower pad, the bottom surfaces of the recesses being spaced apart from the bottom of the storage space, and side-reinforcing hollow projections which are inserted approximately halfway into correspondingly positioned lower-pad hollow projections, when the reinforcing pad is placed under the lower pad.

* * * * *

UNITED STATES PATENT AND TRADEMARK OFFICE

CERTIFICATE OF CORRECTION

PATENT NO. : 6,877,608 B2
DATED : April 12, 2005
INVENTOR(S) : Motomu Koike

It is certified that error appears in the above-identified patent and that said Letters Patent is hereby corrected as shown below:

Title page,
Item [54], Title, change "CUSHION MATERIAL FOR PACKAGING AND PACKAGE" to -- PACKAGE CUSHION MEMBER AND PACKAGE --

Signed and Sealed this

Twelfth Day of July, 2005

JON W. DUDAS
*Director of the United States Patent and Trademark Office*